US007648265B2

(12) United States Patent
Grossman et al.

(10) Patent No.: US 7,648,265 B2
(45) Date of Patent: Jan. 19, 2010

(54) REGULATORLESS OSCILLATING SYSTEM FOR A WATCH

(75) Inventors: Lutz Grossman, Glashütte (DE); Jörg Gassmann, Dresden (DE)

(73) Assignee: Lange Uhren GmbH, Glashütte (DE)

( * ) Notice: Subject to any disclaimer, the term of this patent is extended or adjusted under 35 U.S.C. 154(b) by 0 days.

(21) Appl. No.: 11/982,479

(22) Filed: Nov. 2, 2007

(65) Prior Publication Data

US 2008/0117721 A1 May 22, 2008

(30) Foreign Application Priority Data

Nov. 3, 2006 (DE) ..... 10 2006 052 245

(51) Int. Cl.
*G04B 17/04* (2006.01)

(52) U.S. Cl. ..... 368/178; 368/175

(58) Field of Classification Search ..... 368/175–178
See application file for complete search history.

(56) References Cited

U.S. PATENT DOCUMENTS

| | | | | |
|---|---|---|---|---|
| 273,138 | A | 2/1883 | Oldroyd et al. | |
| 3,262,261 | A | 7/1966 | Monnin | |
| 3,528,237 | A * | 9/1970 | Suard | 368/175 |
| 5,907,524 | A * | 5/1999 | Marmy et al. | 368/175 |
| 7,018,092 | B2 | 3/2006 | Müller | |

FOREIGN PATENT DOCUMENTS

| | | |
|---|---|---|
| CH | 81336 | 11/1919 |
| CH | 310282 | 10/1955 |
| CH | 375297 | 1/1962 |
| DE | 922 453 | 1/1955 |
| DE | 1 173 392 | 7/1964 |
| DE | 1 200 750 | 9/1965 |
| DE | 2 027 284 | 10/1971 |
| DE | 73 24 330 | 9/1973 |

OTHER PUBLICATIONS

GMT Great Magazine of Timepieces—gmtmag.com/en/$13_{13}$ $inn_{13}$ spiromax.php :: 2008.*
Search Report for the corresponding European application No. EP 07 02 0869.
Examination Report dated Aug. 23, 2007 issued for the corresponding German Patent Application No. 10 2006 052 245.1.

* cited by examiner

*Primary Examiner*—Vit W Miska
*Assistant Examiner*—Sean Kayes
(74) *Attorney, Agent, or Firm*—Cohen Pontani Lieberman & Pavane LLP

(57) ABSTRACT

A regulatorless oscillating system for a watch includes a spiral balance spring having an inner fastening point attached to a collet which can be connected to a balance staff, an outer fastening point connected to a balance spring stud, and an end region adjacent to the stud. The end region is held so that it can be adjustably positioned in a plane which is perpendicular to the balance staff, thereby decentralizing the balance spring in order to compensate for isochronism errors.

20 Claims, 11 Drawing Sheets

REGULATORLESS OSCILLATING SYSTEM FOR A WATCH

BACKGROUND OF THE INVENTION

1. Field of the Invention

The invention relates to an oscillation system for a watch, having a spiral balance spring, the inner fastening point of which is connected to a balance staff, in particular by means of a collet, the outer fastening point of which is connected to a retaining element, in particular by means of a balance spring stud.

2. Description of the Related Art

An oscillating system for a watch is isochronous if it has the same oscillation period at any amplitude. Amplitude in this case is the oscillation range of the balance. The amplitude varies depending on the state of winding and, among other things, the conditions of friction in the watch. For example, the friction of the balance in flat positions is not the same as in suspended positions. As a result, the watch will usually have a higher amplitude in the flat position than in suspended positions.

One possibility for eliminating the isochronism error involves the use of a regulator. Depending on the distance of the regulator pins, oscillations at small amplitudes can be speeded up or slowed down. This means, however, that the watch without a regulator must run significantly faster at low amplitudes than at high amplitudes. This condition is achievable by the appropriate selection of the fastening points.

The use of a regulator involves expense. Furthermore, additional isochronism errors can be caused by the regulator. In addition, regulator pins can wear and can have a negative influence on the long-term performance of the watch.

SUMMARY OF THE INVENTION

An object of the invention is accordingly to make available an oscillation system wherein the isochronism error can be reduced by simple means.

This object is achieved according to the invention in that the end region of the balance spring adjacent to the retaining element is adjustably positionable in a plane perpendicular to the balance staff.

At the same time, the end region can be adjusted radially in relation to the balance staff or can also be set (positioned) by causing it to pivot about an axis parallel to the balance staff.

This configuration permits the decentralization of the balance spring to be set accurately, as a result of which the isochronism error is at least considerably reduced, if not completely eliminated.

The configuration according to the invention offers the possibility of dispensing entirely with a regulator.

As a result, the possibility of new isochronism errors attributable to a regulator is excluded.

One embodiment of the invention involves the outer fastening point of the balance spring being attached to the retaining element, in particular to the balance spring stud, the retaining element being capable of being set radially in relation to the balance staff and/or being capable of adjustment by causing it to pivot about the axis parallel to the balance staff.

In a further configuration of the invention, the outer fastening point of the balance spring to the retaining element, in particular to the balance spring stud, can be arranged and held in place radially in relation to the balance staff and/or can be capable of adjustment by being caused to pivot about the axis parallel to the balance staff.

A further possible configuration of the invention involves the outer end of the balance spring being attached to the retaining element, in particular to the balance spring stud, the end region of the balance spring adjacent to the retaining element being permanently in bearing contact at a distance from the retaining element with a positioning element that is capable of being adjusted approximately transversely in relation to the longitudinal extent of the balance spring.

In order to generate a tension on the balance spring, it is possible for the end region of the balance spring adjacent to the retaining element to be bent radially outwards through a flat angle, or for the outer end of the balance spring to be attached to the retaining element under the generation of a tension in the plane perpendicular to the balance staff on the end region of the balance spring adjacent to the retaining element.

The axis parallel to the balance staff, about which the outer end of the balance spring can be set and adjusted by being caused to pivot, can extend through the balance spring stud, in particular centrally through the balance spring stud.

It is also possible, however, for the axis parallel to the balance staff to extend at a distance to the balance spring stud.

For the purpose of retaining the balance spring stud, the balance spring stud can be arranged on a fixed balance spring stud carrier.

To ensure the setting capability of the end region of the balance spring, the balance spring stud can be arranged on a balance spring stud carrier, which is capable of being set by causing it to pivot about the axis parallel to the balance staff.

To ensure the further setting capability, the outer end of the balance spring that is bent radially can be displaced in a radial guide of the fixed retaining element and can be held in place in its predetermined position on the retaining element.

The outer end of the balance spring can be bent outwards in the plane perpendicular to the balance staff.

For this purpose, the outer end of the balance spring that is bent in the plane perpendicular to the balance staff can be displaced in a radial guide of the fixed retaining element and can be held in place in its predetermined position on the retaining element.

A further possibility involves the outer end of the balance spring extending more or less tangentially in relation to the balance staff, in conjunction with which the outer end of the balance spring can be provided with a Breguet terminal curve.

The outer end of the balance spring that is bent radially or extends more or less tangentially can be displaced in a radial guide and can be held in place in a predetermined position.

The ability of the outer end of the balance spring to be adjusted radially and/or to pivot can be applied advantageously in balance springs with the most varied cross sections.

The balance spring can possess a rectangular cross section or also a circular cross section. However, it can also possess any other cross section, in particular a cross section approximating a rectangular cross section or a circular cross section.

Illustrative embodiments of the invention are depicted in the drawing and are described in greater detail below.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PREFERRED EMBODIMENTS

Figure 1:
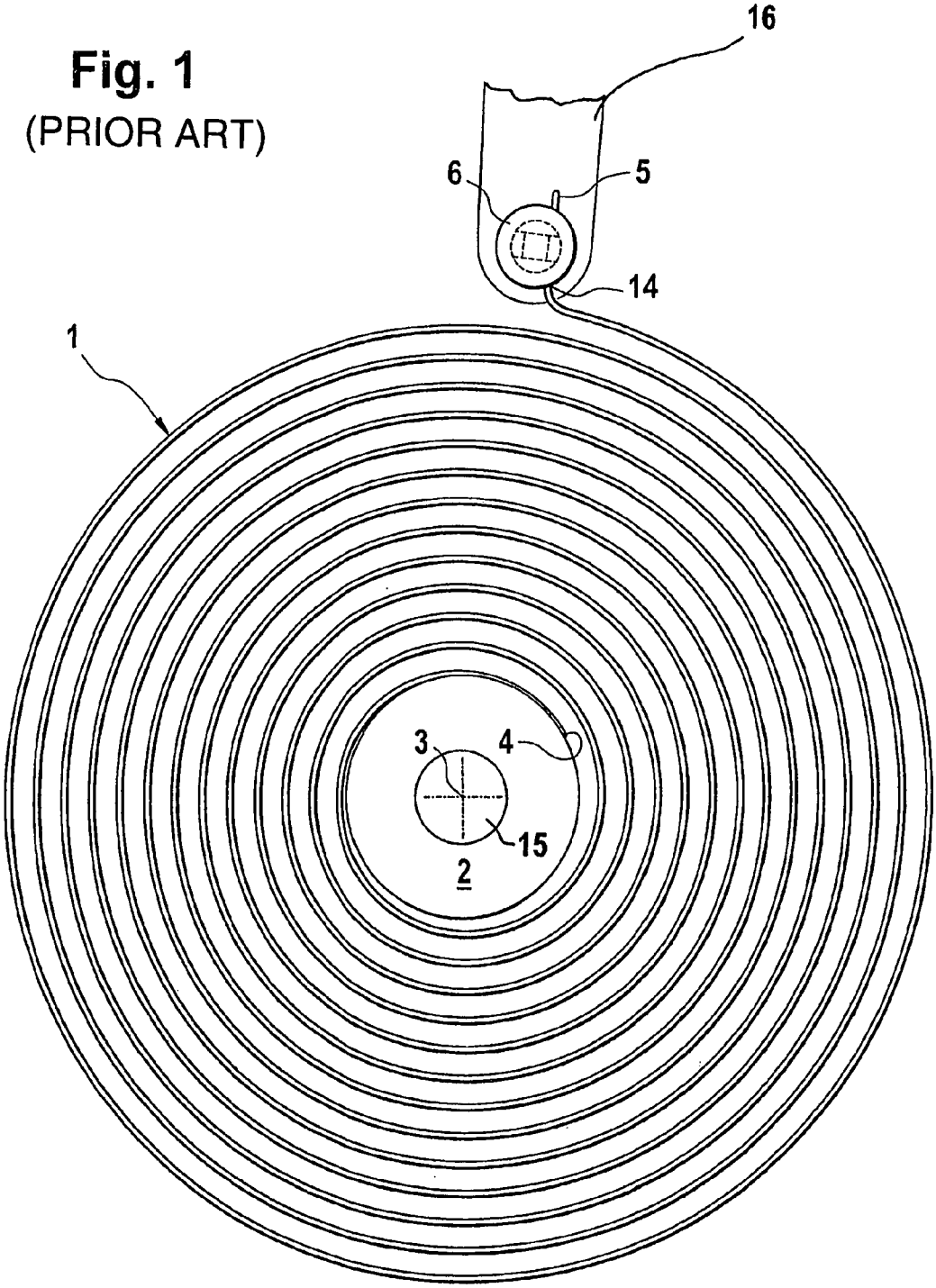
Fig. 1 (PRIOR ART)
FIG. 1 is a plan view of a prior art balance spring that is not under tension.

The spiral balance springs 1, 1', 1", 1''' of a balance for a watch depicted in the Figures are attached by their inner fastening point 4 to a collet 2, which is arranged so that it is concentrically secured to a balance staff (not illustrated here).

The balance staff and the collet 2 are rotatably mounted about an axis of rotation 3.

The radially outer ends 5 of the balance springs 1, 1', 1", 1''' are bent outwards in the plane perpendicular to the balance staff and are attached to a balance spring stud 6 and exhibit an outer fastening point 14.

In FIG. 1, which depicts a balance spring 1 according to the prior art, the balance spring stud 6 is arranged in a fixed manner on a balance spring stud carrier 16. The balance spring 1 is located in a position in which it is centralized in relation to the axis of rotation 3 of the balance staff.

Figure 2:
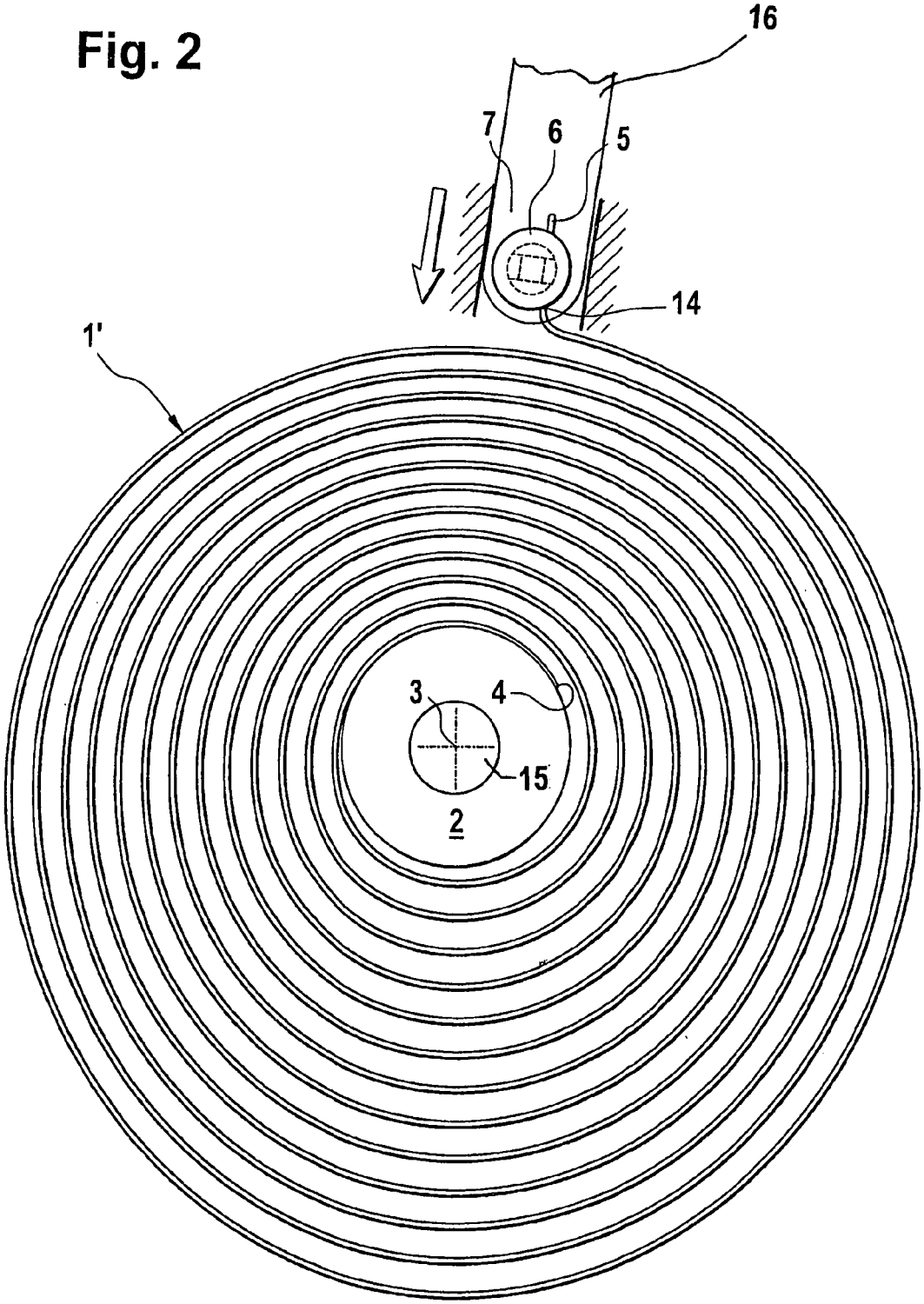
FIG. 2 is a plan view of a first illustrative embodiment of a balance spring that has been decentralized by the displacement of the outer fastening point of the balance spring towards the balance staff.

In FIG. 2, the balance spring stud 6 is so arranged as to be capable of radial displacement in a radial guide 7 arranged in a fixed manner on a balance spring stud carrier 16, and the outer end of the balance spring 1' is displaced radially inwards with it and is held in place in this position in such a way that the balance spring 1' is decentralized towards the axis of rotation 3 of the balance staff.

Figure 3:
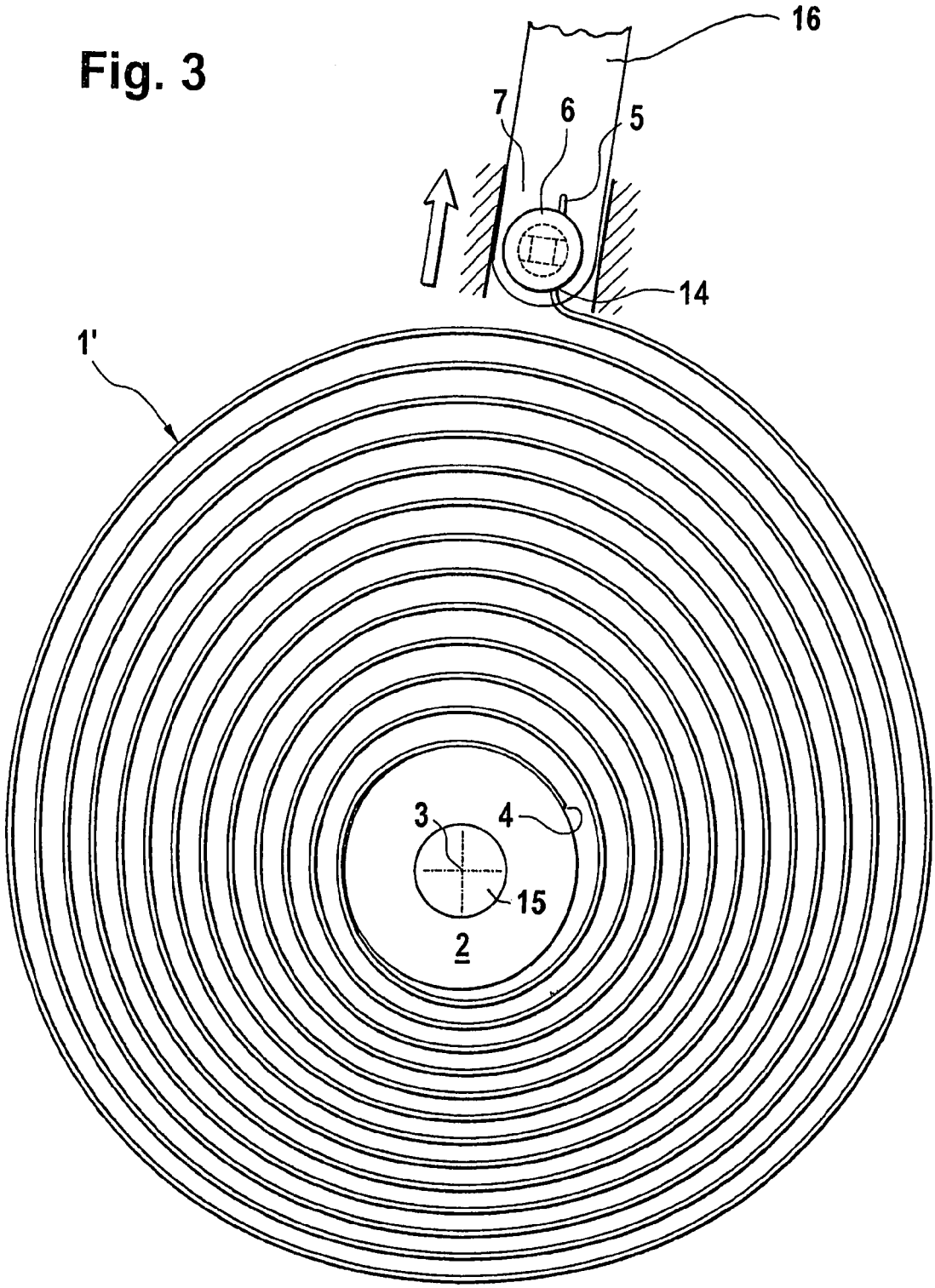
FIG. 3 is a plan view of the balance spring according to FIG. 2 that has been decentralized by the displacement of the outer fastening point of the balance spring away from the balance staff.

FIG. 3 depicts the same arrangement as FIG. 2.

In this case, however, the balance spring stud 6 in the radial guide 7, and with it the outer end of the balance spring 1', is displaced radially outwards and is held in place in this position in such a way that the balance spring 1' is decentralized away from the axis of rotation 3 of the balance staff.

Figure 4:
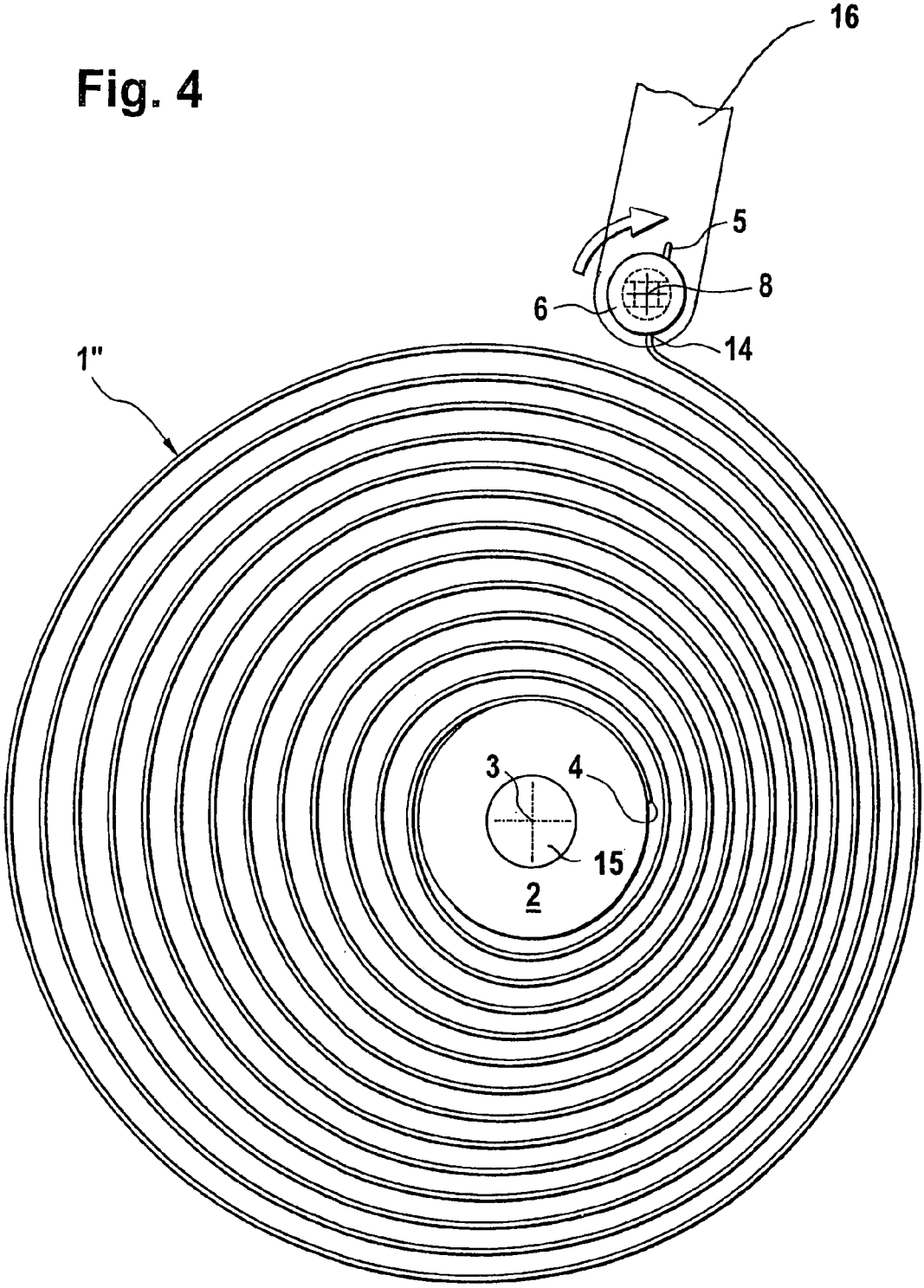
FIG. 4 is a plan view of a second illustrative embodiment of a balance spring that has been decentralized by the gyratory displacement of the outer fastening point of the balance spring towards the balance staff.
Figure 5:
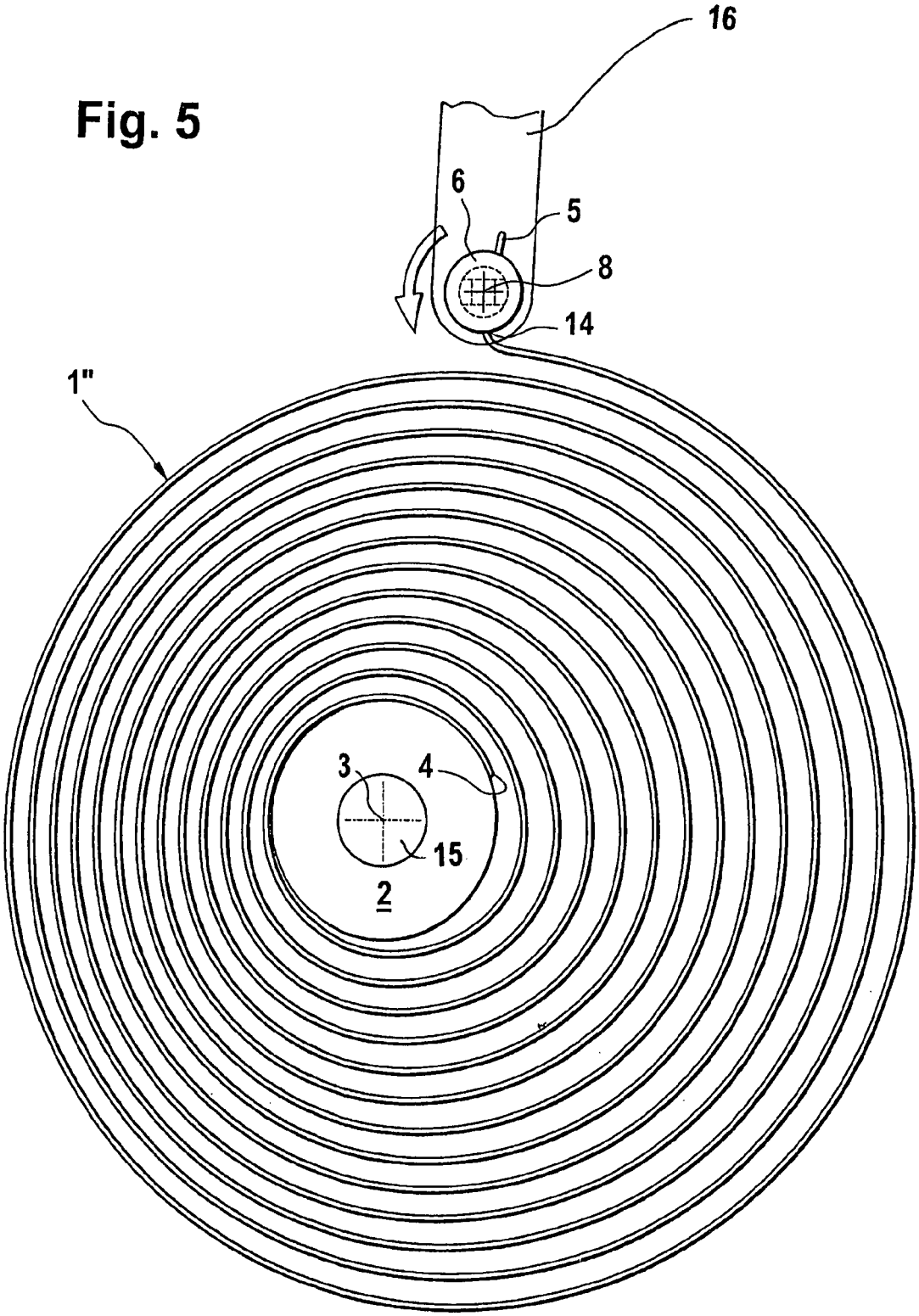
FIG. 5 is a plan view of the balance spring according to FIG. 4 that has been decentralized by the gyratory displacement of the outer fastening point of the balance spring away from the balance staff.

In the illustrative embodiment in FIGS. 4 and 5, the balance spring stud 6 is arranged in a fixed manner on a balance spring stud carrier 16, but is capable of being set in a rotatable manner about its central axis 8 that is parallel to the axis of rotation 3 of the balance staff and is capable of being held in place in the set position of rotation, e.g. by a set screw (not shown).

In FIG. 4, the balance spring stud 6 has been caused to rotate in a clockwise direction about the axis 8 and is held in place, so that the balance spring 1" twists towards the axis of rotation 3 of the balance staff and the balance spring 1" is accordingly decentralized in relation to the balance staff.

FIG. 5 depicts the same arrangement as FIG. 4.

In this case, the balance spring stud 6 has been caused to rotate in a counter-clockwise direction about the axis 8 and is held in place, so that the outer end 5 of the balance spring 1" twists away from the axis of rotation 3 of the balance staff and the balance spring 1" is accordingly decentralized in relation to the balance staff.

Figure 6:
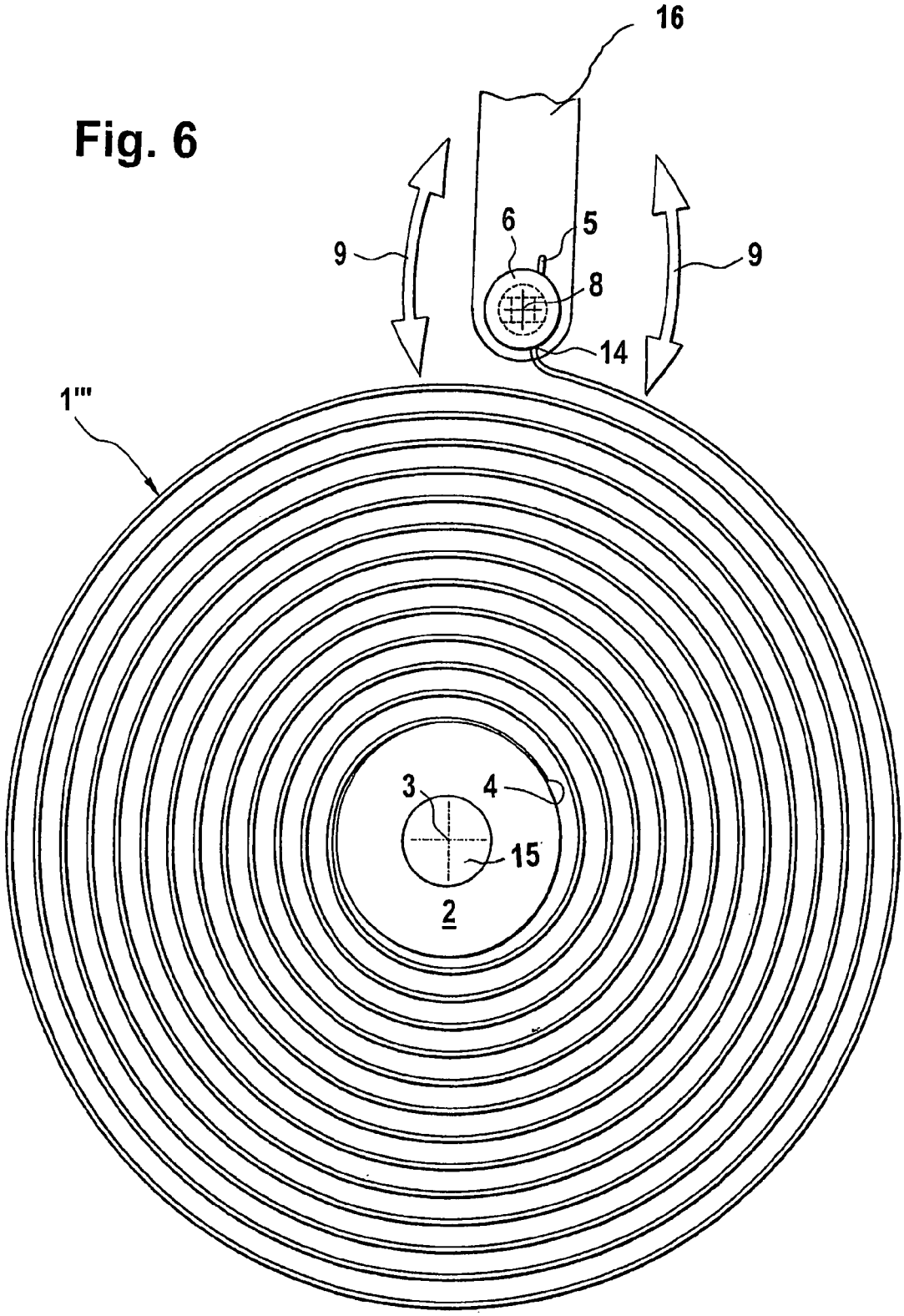
FIG. 6 is a plan view of a third illustrative embodiment of a balance spring that has been decentralized both by displacement and by the gyratory displacement of the outer fastening point of the balance spring towards the balance staff.

Depicted symbolically in FIG. 6 by two arrows 9 is the movement of the balance spring stud 6 and with it the outer end 5 of the balance spring 1''' on an imaginary circular path, of which the pivot axis is situated remotely from the axis of rotation 3 of the balance staff. For this purpose, the balance spring stud 6 can be connected in a fixed manner to a balance spring stud carrier (not illustrated here), which is caused to pivot about an axis parallel to the axis of rotation 3.

The resulting movement of the balance spring stud 6 will be more translatory or more gyratory in nature, depending on whether the pivot axis is arranged far away from or close to the central axis 8 of balance spring stud 6.

In FIGS. 7 to 11, the outer end 5 of the balance spring 1'''' is attached to the fixed balance spring stud 6. The balance spring stud exhibits a stud arm 11 extending in the direction of the end region 10 of the balance spring 1'''', which stud arm has a threaded bore extending transversely to the longitudinal extent of the end region 10 of the balance spring 1''''.

Screwed into the threaded bore is an adjuster screw 12, which, at its end facing away from the end zone 10, has a screw head 13 for turning the adjuster screw 12.

The adjuster screw 12 is in bearing contact at its end opposite the screw head 13 with the end region 10 of the balance spring 1''''.

Figure 11:
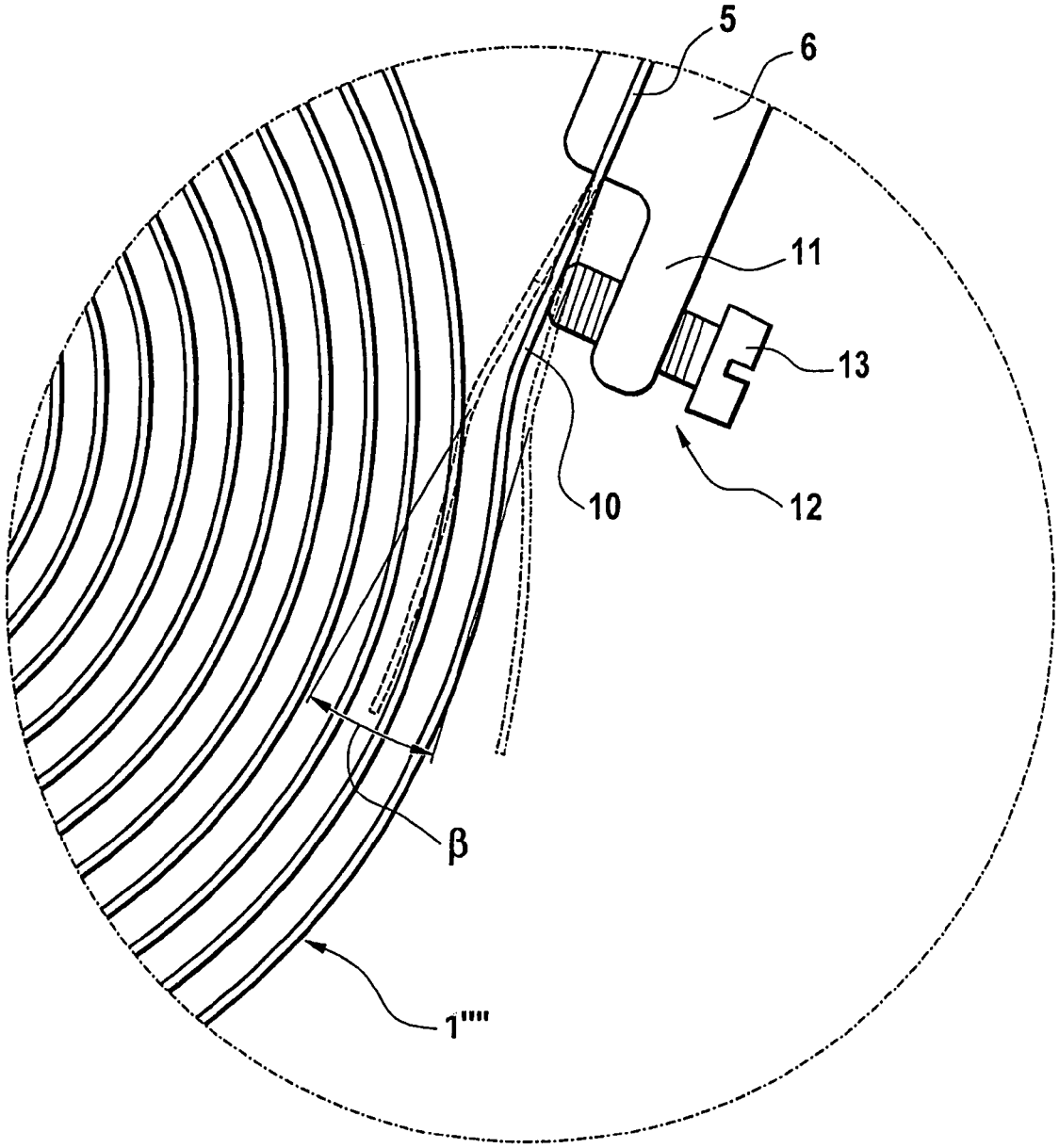
FIG. 11 is a plan view of the range of adjustment of the end region of the balance spring according to FIG. 7.

As can be appreciated from FIG. 11 in particular, the outer end region 10 of the balance spring 1'''' can be deflected to a greater or lesser extent by moving the adjuster screw 12. The escapement curve can also be influenced by the deflection angle $\beta$ in each case.

The balance spring 1'''' is bent outwards through an acute angle at the beginning of its end zone 10 and is clamped to the balance spring stud 6 in a fixed manner by its outer end 5, in such a way that the end region 10 is always in bearing contact with the adjuster screw 12 with tension.

Figure 7:
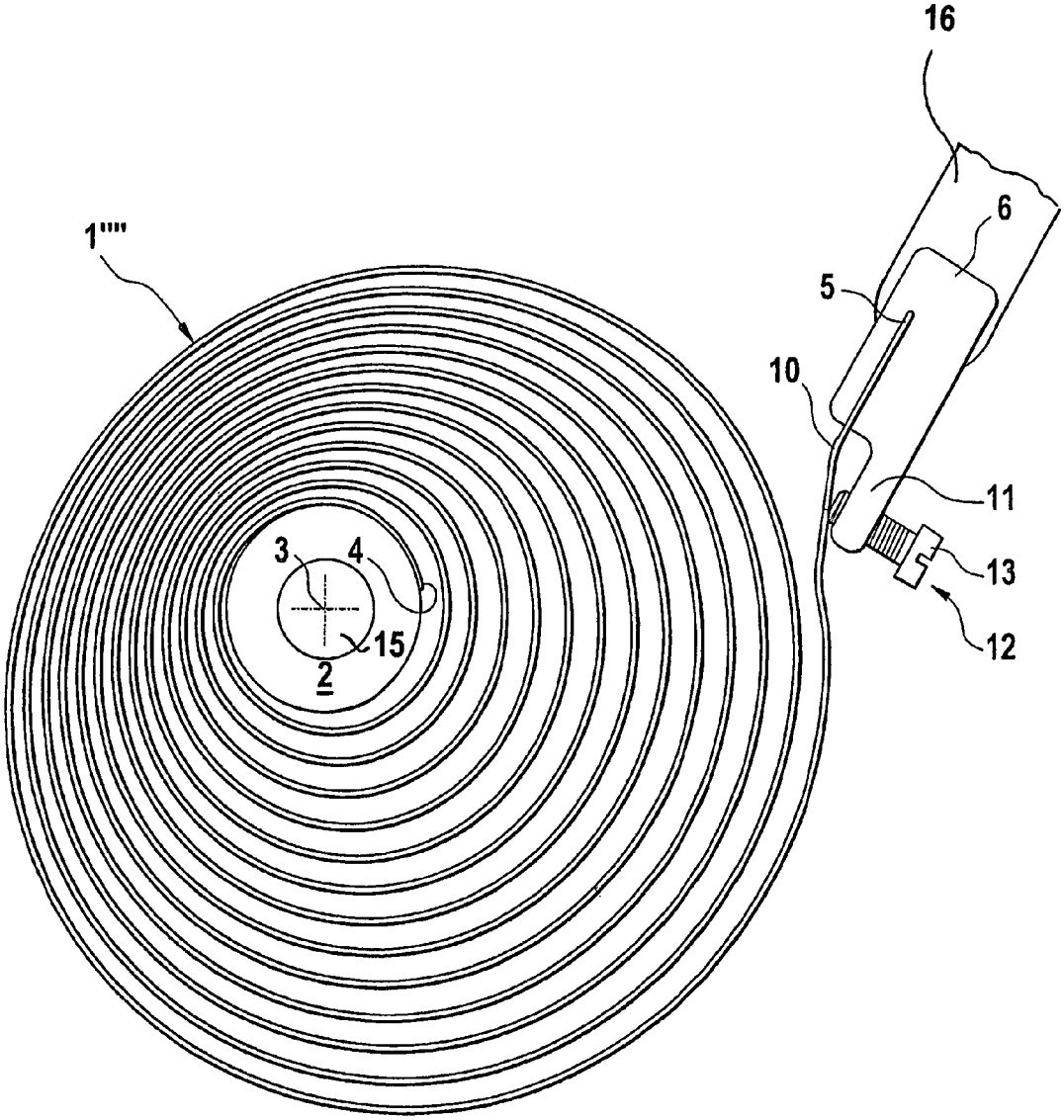
FIG. 7 is a plan view of a fourth illustrative embodiment of a balance spring having an end region that is not under tension.

In the course of assembly, the adjuster screw 12 according to FIG. 7 is brought into a position in which it does not project from the stud arm 11 to any great extent and does not influence the balance spring 1''''.

The fact that the balance staff is in a fixed position means that the balance spring 1'''' is strongly decentralized.

Figure 8:
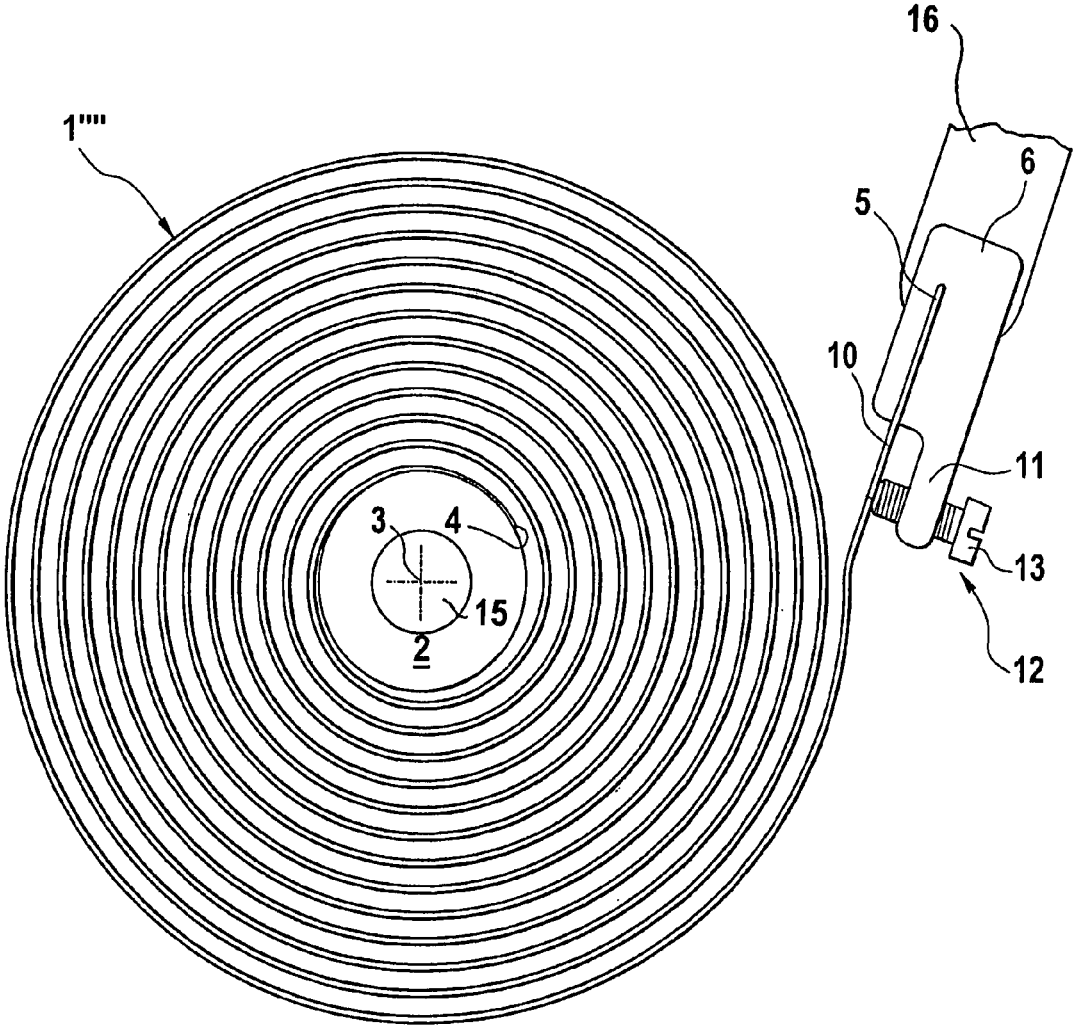
FIG. 8 is a plan view of the balance spring according to FIG. 7 in a central position.

Accordingly, as depicted in FIG. 8, the adjuster screw 12 is used in order to bring the balance spring 1'''' into a central position in relation to the balance staff.

Figure 9:
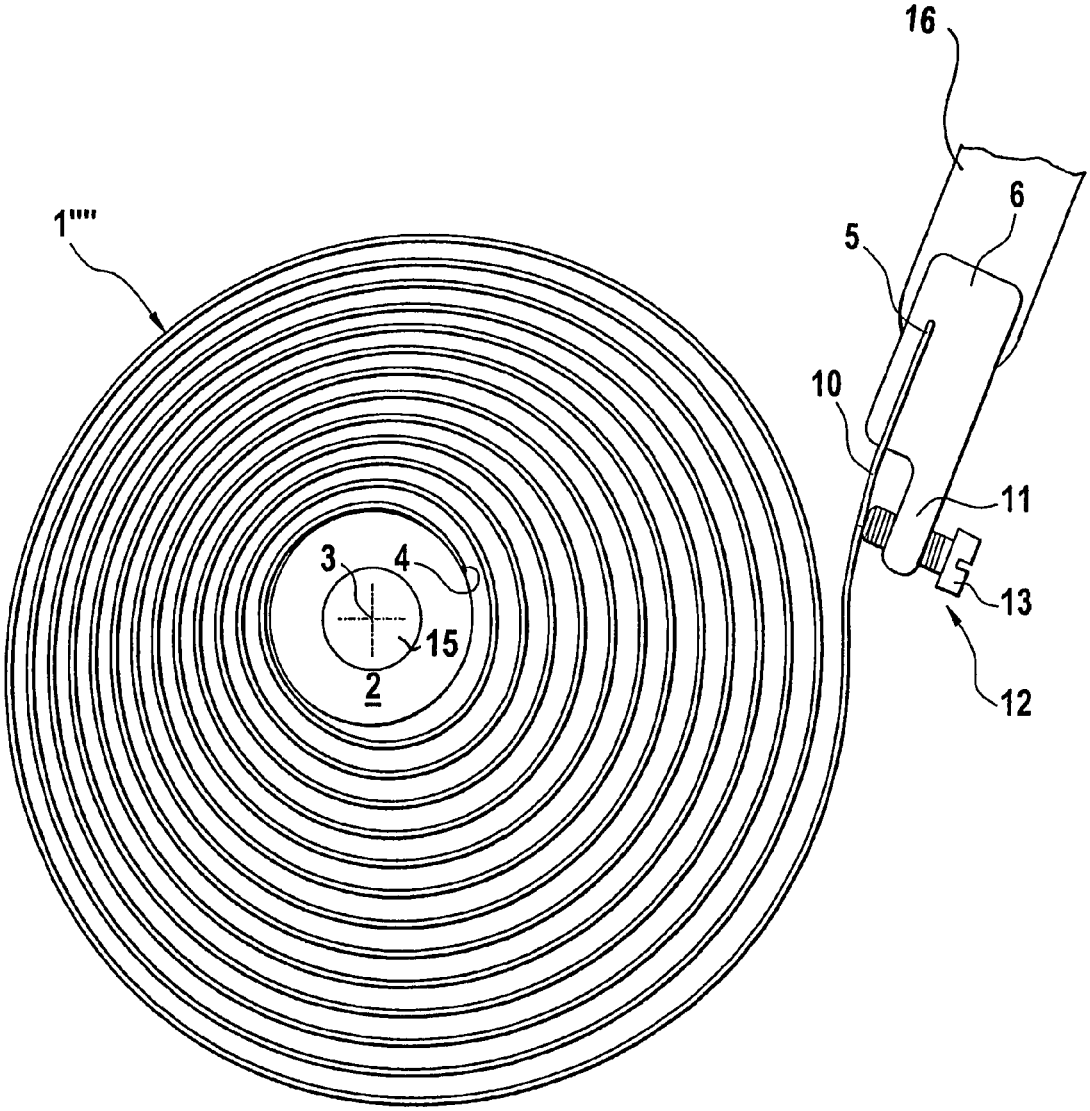
FIG. 9 is plan view of the balance spring according to FIG. 7 in an extreme decentralization position under low tension.
Figure 10:
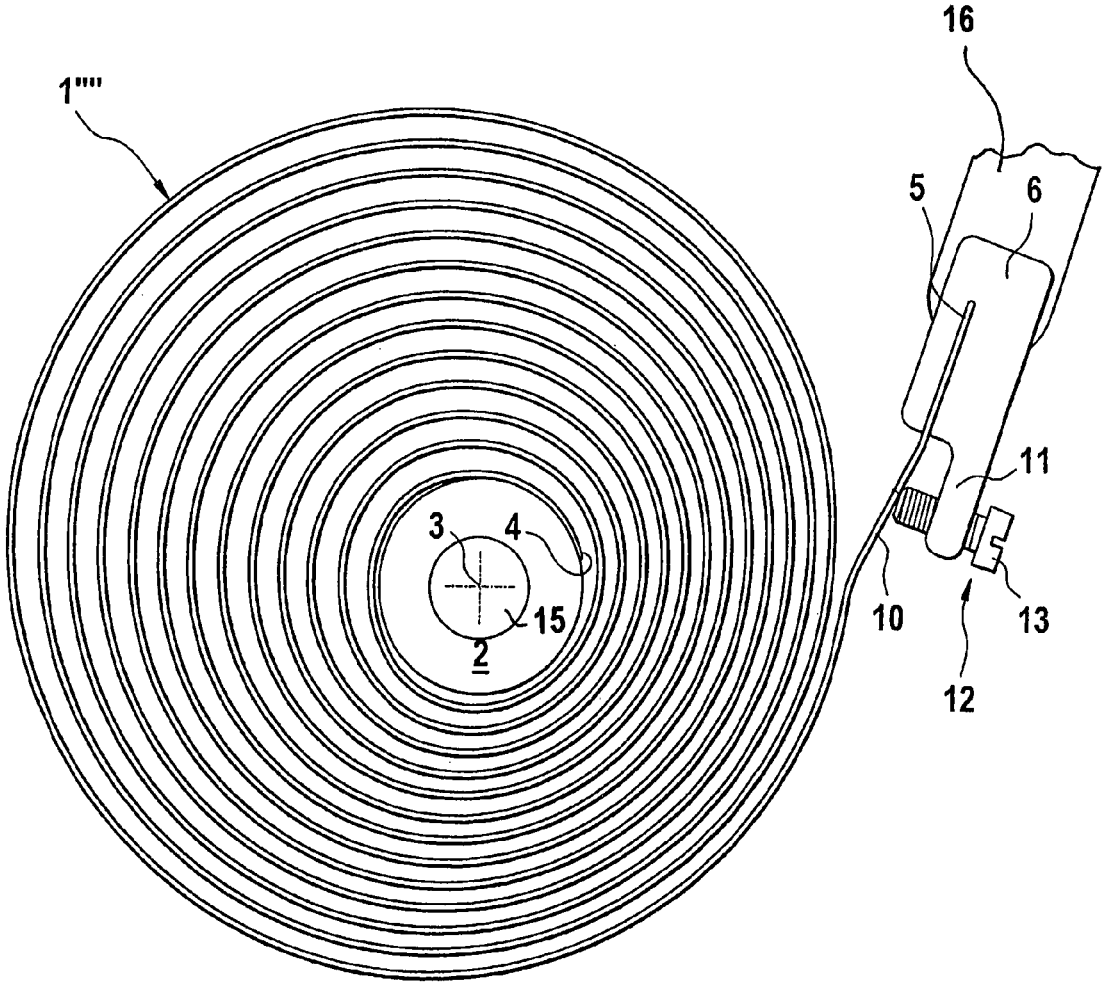
FIG. 10 is a plan view of the balance spring according to FIG. 7 in a second extreme decentralization position under high tension.

FIGS. 9 and 10 illustrate the two extreme decentralization positions, into which the balance spring 1"" can be brought, and by means of which an isochronism error can be reduced.

The self-tensioning of the balance spring 1"" must be sufficient to prevent the end region 10 from lifting from the adjuster screw 12, including in conjunction with a small deflection of the balance spring 1"" corresponding to FIG. 9 and even in the event of the balance spring 1"" "breathing".

This would otherwise result in an extension of the length of the vibrating balance spring and would have an influence on the escapement.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A regulatorless oscillating system for a watch, the system comprising a balance spring, the balance spring comprising:

an inner fastening point attached to a collet which can be connected to a balance staff;

an outer fastening point connected to a retaining element; and an end region adjacent to the retaining element, wherein the end region is held so that said end region can be adjustably moved in a plane which is perpendicular to the balance staff without changing an effective length of the balance spring.

2. The oscillating system of claim 1 wherein the end region is held so that it can be adjustably moved radially relative to the balance staff.

3. The oscillating system of claim 1 wherein the end region is held so that it can be adjustably pivoted about an axis which is parallel to the balance staff.

4. The oscillating system of claim 3 wherein the retaining element is a balance spring stud, said axis extending through said balance spring stud.

5. The oscillating system of claim 3 wherein the retaining element is a balance spring stud, said axis being spaced from said balance spring stud.

6. The oscillating system of claim 3 wherein the retaining element is a balance spring stud which is arranged on a balance spring stud carrier which can rotate about said axis.

7. The oscillating system of claim 6 wherein the balance spring stud can rotate about a further axis parallel to the balance staff.

8. The oscillating system of claim 1 wherein the outer fastening point is fixed to the retaining element, and the retaining element can be adjustably moved radially relative to the balance staff and/or can be adjustably pivoted about an axis which is parallel to the balance staff.

9. The oscillating system of claim 8 wherein the balance spring has an outer end fixed in said retaining element, said system further comprising a radial guide in which said retaining element can move radially and be fixed in a predetermined position.

10. The oscillating system of claim 1 wherein the outer fastening point can be adjustably moved radially relative to the balance staff, and/or can be adjustably pivoted about an axis which is parallel to the balance staff, and can be fixed in place subsequent to said radial movement and/or said pivoting.

11. The oscillating system of claim 1 wherein the outer fastening point is fixed to the retaining element, the system further comprising a positioning element bearing against the end region at a distance from the retaining element, the positioning element being adjustably movable transversely to the end region so that the end region can be deflected relative to the retaining element.

12. The oscillating system of claim 11 wherein the end region is bent radially outward through an acute angle adjacent to the retaining element.

13. The oscillating system of claim 11 wherein the end region is under spring tension throughout a range of deflection.

14. The oscillating system of claim 1 wherein the retaining element is a balance spring stud which is arranged on a fixed balance spring stud carrier.

15. The oscillating system of claim 1 wherein the balance spring has an outer end extending through said retaining element, said outer end being bent to extend radially outward from said balance staff.

16. The oscillating element of claim 15 the outer end is movable in a radial guide of said retaining element and can be fixed in a predetermined position in said retaining element.

17. The oscillating system of claim 1 wherein the balance spring has an outer end extending through said retaining element, said outer end extending more or less tangentially to said balance staff.

18. The oscillating system of claim 17 wherein the outer end is formed with a Breguet terminal curve.

19. The oscillating system of claim 1 wherein the balance spring has a rectangular cross-section.

20. The oscillating system of claim 1 wherein the balance spring has a circular cross-section.

* * * * *